United States Patent [19]

Rausing

[11] Patent Number: 4,787,507

[45] Date of Patent: Nov. 29, 1988

[54] LIQUID PACK, METHOD OF MANUFACTURE THEREOF AND PLASTICS WEB FOR AN OPENING STRIP FOR THE PACK

[75] Inventor: Hans Rausing, Wadhurst, Great Britain

[73] Assignee: AB Tetra Pak, Lund, Sweden

[21] Appl. No.: 43,033

[22] Filed: Apr. 27, 1987

[30] Foreign Application Priority Data

Apr. 28, 1986 [GB] United Kingdom ..... 8610324

[51] Int. Cl.[4] ..... B65D 5/70

[52] U.S. Cl. ..... 206/617; 206/633; 229/3.5 R; 229/160.2; 428/483; 428/910

[58] Field of Search ..... 229/3.5 R, 125.42, 160.2; 206/613, 617, 618, 631, 633, 631.2, 631.3; 428/43, 35, 480, 483, 910

[56] References Cited

U.S. PATENT DOCUMENTS

| | | | |
|---|---|---|---|
| 2,877,500 | 3/1959 | Rainer et al. | 229/3.5 R |
| 2,961,365 | 11/1960 | Sroog | 229/3.5 R |
| 3,054,703 | 9/1962 | Brasure | 229/3.5 R |
| 3,187,982 | 6/1965 | Underwood et al. | 206/631 |
| 3,188,266 | 6/1965 | Charbonneau et al. | 428/483 |
| 3,455,720 | 7/1969 | Davies et al. | 428/483 |
| 3,497,131 | 2/1970 | Tracy | 206/613 |
| 3,560,223 | 2/1971 | Turbak | 229/3.5 R |
| 3,900,653 | 8/1975 | Riboulet et al. | 428/910 |
| 4,370,293 | 1/1983 | Petersen-Hoj | 264/514 |
| 4,433,784 | 2/1984 | Kjelgaard | 229/137 |
| 4,522,305 | 6/1985 | Jacobsson | 206/632 |

*Primary Examiner*—Stephen Marcus
*Assistant Examiner*—Gary E. Elkins
*Attorney, Agent, or Firm*—Michael L. Dunn

[57] ABSTRACT

Described is a liquid pack made at least partially of cardboard, having a longitudinal weld seam (1) and two transverse weld seams (3) which are disposed in a doubled cardboard strip (2) at the top and underside of the pack, wherein disposed in the upper transverse weld seam (3) is an opening means (6) in the form of a double-ply opening strip (7) which is liquid-tight on one side and whose outward sides are connected to the inward sides of the doubled cardboard strip (2). The opening strip (7) is made of a laminated plastics material in which one layer (21) is oriented in one direction (22).

In order to permit such a pack to be produced from a tubular portion, and yet have a tearing-open action which the final consumer can readily understand, in an economical fashion and with good hygenic properties, the opening strip (7) is of a U-shaped cross-section and is so arranged that the free ends of the limb portions (10, 10') of the U-shape are directed towards the interior of the pack, the limb portions of the U-shape are welded together only at the beginning and the end to provide a beginning sealing region (12) and an end sealing region (13), the beginning sealing region (12) provides a gripping tongue portion behind which it is sealed in the longitudinal sealing seam in the doubled cardboard strip, and the end sealing region (13) is also sealed in the cardboard strip in the pouring-out region of the opening means.

13 Claims, 4 Drawing Sheets

Figures 1, 2:
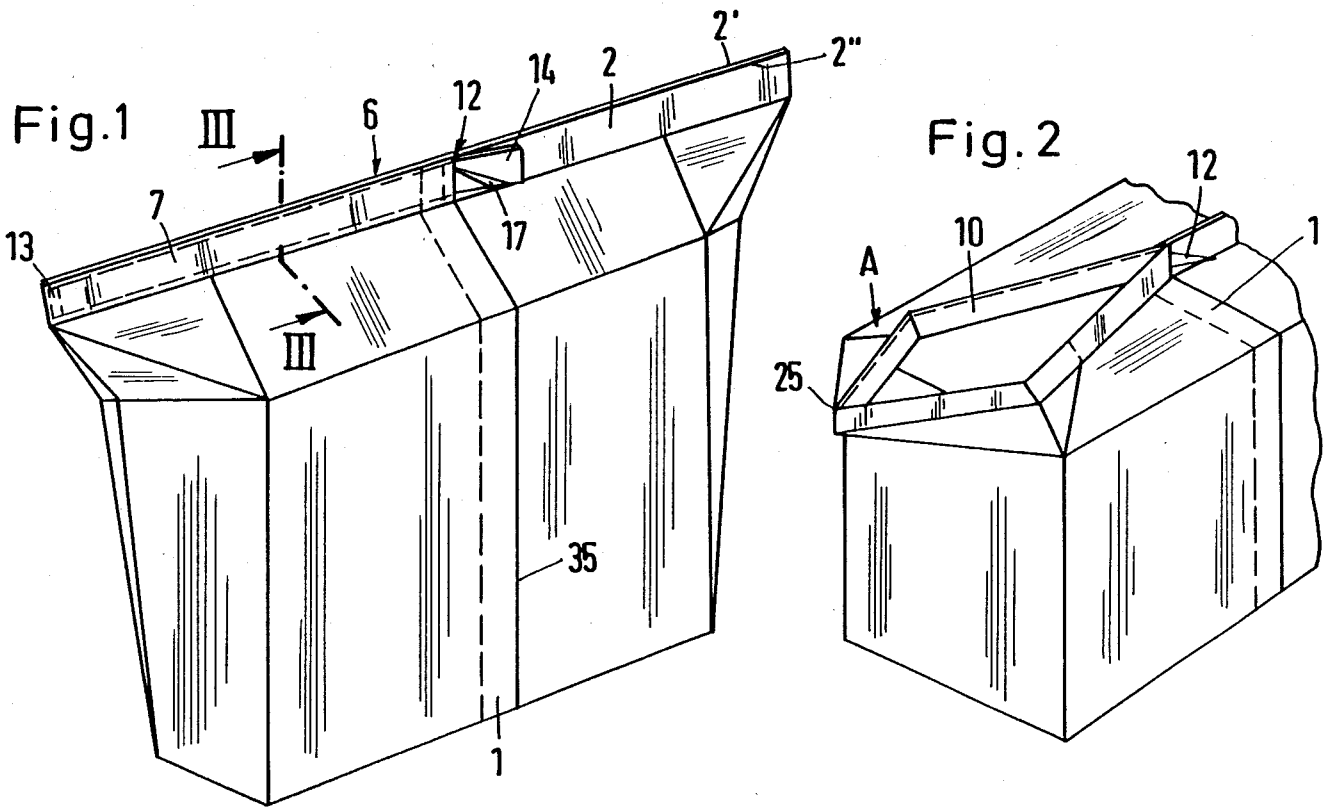

1
12
10
A
25
2"
2'
2
14
17
12
6
III
III
7
13
35
1

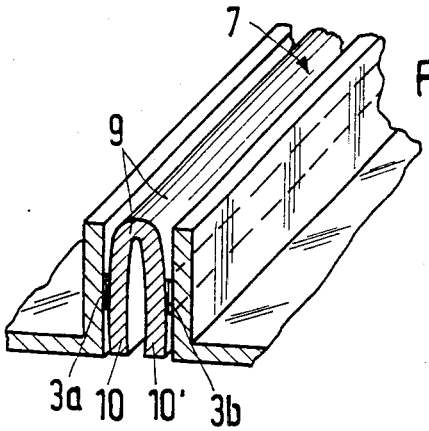
Fig. 3
Fig. 5
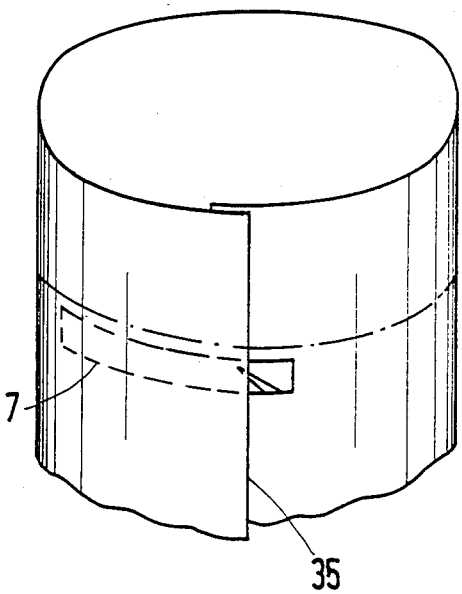
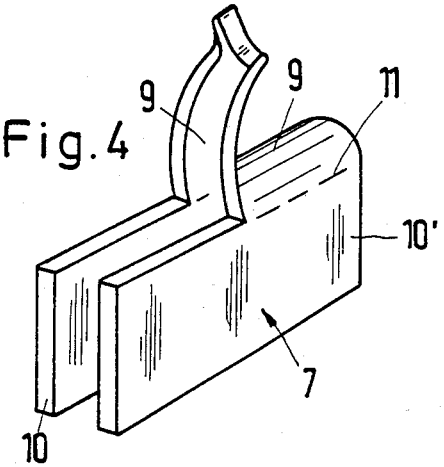
Fig. 4
Fig. 6
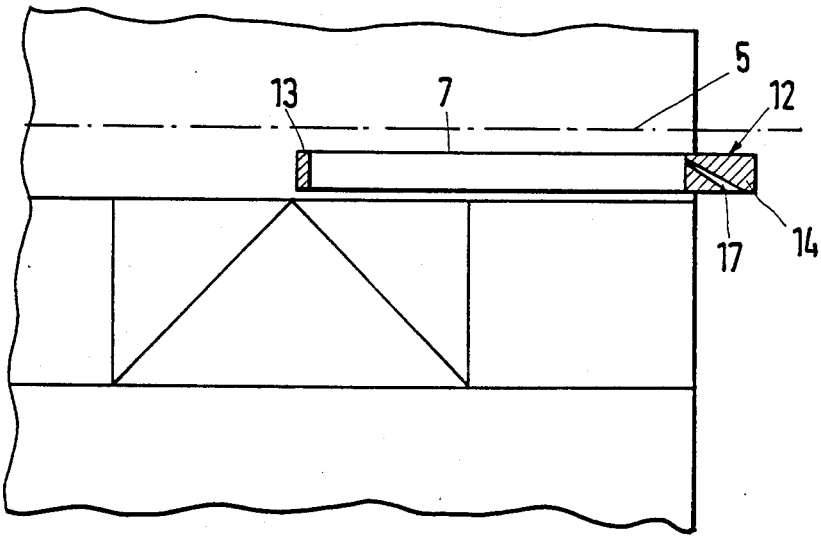

LIQUID PACK, METHOD OF MANUFACTURE THEREOF AND PLASTICS WEB FOR AN OPENING STRIP FOR THE PACK

This invention relates to a pack for a liquid, made at least partially of plastics-coated cardboard carrier material having a longitudinal weld seam and at least one transverse weld seam which is disposed in a doubled cardboard strip at the top of the pack and in which is disposed an opening means in the form of an opening strip which is liquid-tight on one side and whose outward sides are joined to the inward sides of the double cardboard strip, with the opening strip being made of a laminated plastics material, one layer of which is oriented in one direction.

Numerous liquid packs are known which consist of plastics-coated paper, cardboard or the like, for example being of parallelepipedic shape. Such liquid packs involve longitudinal weld seams which extend over the height of the parallelepipedic pack when in an upright condition, and transverse weld seams in the bottom and/or top wall regions of the pack. The conventional parallelepipedic liquid pack is provided at least in the upper region and at oppositely disposed sides with two triangular flaps, and the doubled cardboard strip extends, in such a known pack, from the tip of one of the triangular flaps to the tip of the oppositely disposed other triangular flap.

Numerous proposals for opening means on liquid packs of that kind have been in part considered and in part also already described in the literature. A known opening means comprises a portion of tube of laminated plastics material, with the axis of the tube extending parallel to the longitudinal weld seam and consequently transversely with respect to the transverse weld seam. In order to improve the tearing properties of such a laminated plastics tube, the one layer is oriented or aligned in the tearing direction, and a plastics layer which can provide a better sealing action is laminated on to that first-mentioned layer, on the outside, where it must be joined to the doubled cardboard strip. So that the tube portion which serves as the opening means and which consists of plastics material can be closed off, the tube must project upwardly out of the doubled cardboard strip of the liquid pack, thus giving rise to the disadvantage that such a pack cannot be manufactured from the tube, or the tube must be capable of being welded on its side which is towards the interior of the pack, for which reason the regions which have a lower degree of sealability must be arranged in a particular fashion and preferably must project downwardly towards the interior of the pack. This arrangement gives rise to the disadvantage that on the one hand pockets which are accessible from the outside are formed within the tube portion, with the problems regarding hygiene that such pockets involve, while on the other hand complicated manufacture of the tube portion makes the incorporation of such an opening means an uneconomical proposition.

There is thus a need for a generally improved pack for a liquid, the manufacture of which from a tube permits a tear-open action which is readily understandable by the final consumer, with a simple opening means which can be produced at low cost, together with good hygenic properties.

According to one aspect of the present invention there is provided a pack for a liquid, made at least partially of plastics-coated cardboard carrier material, having a longitudinal weld seam and at least one transverse weld seam which is disposed in a doubled cardboard strip at the top of the pack and in which is disposed an opening means in the form of an opening strip which is liquid-tight on one side and whose outward sides are joined to the inward sides of the double cardboard strip, with the opening strip being made of a laminated plastics material, one layer of which is oriented in one direction, wherein the opening strip is substantially U-shaped in cross-section and is located such that the free ends of the limb portions of the U-shape are directed towards the interior of the pack, the limb portions of the U-shape are welded together only at the beginning and the end of the opening strip to form an initial sealing region and an end sealing region, the initial sealing region provides a gripping tongue portion projecting out of the doubled cardboard strip, and is sealed relative to the remainder of the opening strip in the region of the intersecting longitudinal and transverse weld seams in the doubled cardboard strip and the end sealing region is sealed, in a pouring-out region of the opening means, in the doubled cardboard strip.

The novel configuration and arrangement of the opening strip in accordance with the present invention advantageously eliminates the formation of pockets which are accessible from the outside and in which contaminating matter could accumulate. The final consumer immediately recognises the gripping tongue portion or flap which sticks out from the doubled cardboard strip and which the consumer, without any uncertainty, can grasp and pull up in the only possible direction, namely towards the pouring-out side of the opening means. On doing that, the consumer is surprised to find that it is not the case for example that the opening strip is torn off the doubled cardboard strip, but that the opening strip itself opens at its top where the two limb portions of the U-shape are joined together by the connecting web portion. By web is intended herein a thin sheet, plate or strip. In accordance with the present invention, the web is a laminated web, i.e. composed of multiple layers. That design configuration provides a tear-open action which is readily understandable by the final consumer and which gives good hygenic properties. In addition, the provision of the novel opening strip, including the development and manufacture thereof, is economically very low-cost for the pack manufacturer.

The initial or beginning sealing region is called that because the final consumer begins the operation of tearing open the pack in that region. Only a portion of that region forms the gripping tongue portion, with the other second portion forming the front closure means, while the end sealing region forms the rear closure means of the opening strip with the doubled cardboard strip. At the top, that is to say towards the exterior, the opening strip is closed, by means of the connecting web portion thereof.

The end sealing region does not have to be disposed precisely at the tip of the pouring end, that is to say in the tip of the double-ply triangular flap, or a parallelepipedic pack, but on the contrary, if desired, the opening strip can be extended with the end sealing region beyond the location of the pouring-out tip, being of a folded-over configuration, so that then it is still to be found in the pouring-out region. In other words, the opening strip can be of a shorter or longer configuration by virtue of that arrangement, and it is possible to influence the sticking and fixing of the opening strip on the web of material, for example reinforcing same by virtue of using larger surface areas.

Desirably, a further embodiment of the invention provides that a tear-open slot is provided within the initial or beginning sealing region, passing completely through the opening strip and extending rearwardly upwardly from the lower free ends of the limb portions on the outside at the front at the gripping tongue portion. The above-mentioned tear-open slot makes it easier to carry out the pack-opening operation because the location at which the step of tearing open the pack is begun is fixed at the correct position in the opening strip, being governed by the tear-open slot, and the operation of tearing open the pack begins at the correct location in the vicinity of the upper connecting web portion.

Therefore, it is particularly advantageous for the end of the tear-open slot to be provided adjacent the upper connecting web portion joining the two limb portions of the opening strip. When the connecting web portion is torn up by the final consumer, without that person giving a great deal of attention to that operation, the tearing effect begins in the upper region of the opening strip and thus also of the doubled cardboard strip, and that arrangement ensures in a particularly satisfactory manner that the tearing operation does not begin at the side, which could possibly result in the doubled cardboard strip being ruined. The opening strip is in practice opened only along its own upper connecting web portion.

If, advantageously, the connecting web portion of the opening strip is arranged within the outside contour of the doubled cardboard strip, then the liquid pack can be particularly advantageously produced from a tubular configuration because the filled web is then always severed or cut through in the filling machine, outside of the opening strip, more specifically directly outside same. The line at which the web is severed between two packs which are disposed in succession within the tubular web configuration is thus directly outside the opening strip so that the latter remains closed but nonetheless the pack can be separated off or isolated.

If, for preferred reasons, a wider opening strip is to be used, it may also be advantageous in accordance with the invention if the opening strip is provided to extend out of the doubled cardboard strip into the interior of the pack.

When liquid packs are produced from a tube, the respective ends of the two packs which are to be separated from each other are sealed off in per se known manner on both sides adjacent the cut line, and the arrangement of the opening strip and the sealing thereof to the web of material must be so matched to the position of the respective transverse sealing seam that there is no fear of leakage. In that respect, it is particularly advantageous in accordance with the invention if the beginning sealing region extends over the entire width of the opening strip. The sealing region of the opening strip therefore extends beyond the longitudinal sealing seam, into the interior of the pack, thereby ensuring that no liquid can penetrate to the exterior from the inside of the pack, not even when the pack has the tear-open slot.

It is also advantageous if two weakening lines which are disposed at the spacing of a tearing strip from each other are provided, preferably starting from the end of the tear-open slot, in the region of the connecting web portion of the opening strip, extending along the opening strip. That arrangement predetermines a preferential tearing direction, whereby the operation of tearing open the pack is governed along the correct lines, without any contribution on the part of the final consumer in that respect. The above-mentioned weakening lines may be reduced-thickness regions or the like, but a true perforated line is obviously not possible for the weakening lines must remain fluid-tight.

The end welding region may also be welded in close proximity to the pouring-out tip of the opening means and the opening strip may extend from the gripping tongue portion or flap beside the longitudinal sealing seam to the pouring-out tip. More particularly it has been found that in order to save on material it is generally sufficient for the opening strip to be just as long as the opening for the contents to be poured out. Alternative options in regard to fitting the opening strip around the pouring tip were discussed hereinbefore.

It is also advantageous if a second plastics layer which is better heat-sealable than the first layer is applied to the surface of the first plastics layer which is oriented in the longitudinal direction of the opening strip, and a third plastics layer which is also better heat-sealable is applied to the first layer on the other oppositely disposed surface of the first layer, with the sealability temperature of the second layer being lower than that of the third layer. Such a plastics structure is advantageous in regard to sealing the opening strip to the respective inward surfaces of the doubled cardboard strip, without thereby the limb portions of the opening strip being sealed on their inside to the strip or to each other. In other words, the pack could not be opened by tearing up the upper connecting web portion, as is intended, if the opening strip were completely closed off further down. The combination of the individual plastics layers completely eliminates such problems.

In accordance with a further aspect of the invention, the pack having the above-mentioned features preferably is also such that the first layer comprises polyester which is elongated in the longitudinal direction of the opening strip, the second layer comprises a thermoplastic ionomer resin on the basis of cross-linked ethylene copolymers and the third layer comprises PETG. It is possible for example to use cyclohexane-modified polyester as the last-mentioned material. It has been found more particularly that even when such a material is stretched, it does not become crystalline and thus retains its heat-sealability. In that way the opening strip according to the invention can be produced in a particularly good and simple manner and joined to the pack in an advantageous fashion.

According to another aspect of the present invention there is provided a method of manufacturing a pack for liquid, which pack is made at least partially from a plastics-coated cardboard carrier material having a longitudinal weld seam and at least one transverse weld seam which is disposed in a double cardboard strip at the top of the pack and in which there is disposed an opening means in the form of a double-ply opening strip which seals on one side and whose outward sides are joined to the inward sides of the double cardboard strip, with the opening strip being made of a laminated plastics material, one layer of which is oriented in one direction, including the steps of drawing a plastics web for the opening strip from a supply roll, welding the opening strip, which is folded in a U-shape, to itself on its inward sides at the beginning and at the end to form initial and end sealing regions, sealing the opening strip on its one outward side, in proper register, on to the side, which forms the inward side of the pack, of the web of plastics coated cardboard carrier material which is lying in a flat condition, with the sealing operation being effected such that the portion of the initial sealing region which forms a gripping tongue portion, projects beyond a cut edge of the longitudinal sealing seam and perpendicularly with respect thereto, forming the web of material into a tube, providing it with the longitudinal weld seam, filling and closing it by transverse welding along and through the opening strip, separating it from the web and forming it into the final configuration of a pack.

These features provide high-output and clear manufacture because they permit continuous production even of a large number of items per unit of time. The operation of folding the plastics film of the opening strip on to itself in a U-shape and welding it to itself are effected at elevated temperature for preferably in this case the above-mentioned third plastics layer is welded to itself, for which purpose the temperatures required are higher than when producing the conventional longitudinal or transverse weld seams in the paper web. That operation of welding the opening strip which is folded double, to itself, more specifically only in the beginning and end sealing regions, provides for stiffening and strengthening of those welded regions. That is advantageous in particular in regard to the gripping tongue or flap portion which is convenient to handle in particular if it is strong and stiff. However such properties are automatically achieved precisely by virtue of using this production process.

The operation of attaching the opening strip when prepared in that manner to the inward side of the pack web, in proper register therewith, is not difficult from a technical point of view, not even with the condition that the gripping tongue portion projects beyond the cut edge of the web transversely with respect thereto. The longitudinal direction of the opening strip is thus disposed transversely with respect to the cut edge or to the subsequent longitudinal sealing seam. If more particularly the web of material which is thus provided with the opening strip is then formed into a tube and closed by way of the longitudinal weld seam, then the gripping tongue portion projects from that longitudinal weld seam. The steps which are conventional thereafter for making up the pack are known per se.

In manufacture of such a liquid pack, it is particularly advantageous if, before or after the operation of double folding of the opening strip and partial welding thereof to itself, a tear-open slot is produced in the beginning sealing region. The position and arrangement of the tear-open slot have already been referred to hereinbefore. Therefore, it is particularly desirable if the tear-open slot is disposed within the beginning sealing region, passing completely through the opening strip and extending rearwardly upward from the lower free ends of the limb portions on the outside at the front at the gripping tongue portion. In that connection it should be repeated that the tear-open slot can be formed both prior to the operation of folding the opening strip double or also after the operation of folding same, and in that respect prior to its being welded to itself or also thereafter.

According to a further aspect of the present invention there is provided a plastics web for an opening strip, having a first layer of the web oriented in one direction, a second plastics layer which is better heat-sealable than the first layer applied to one surface of said first layer, and, applied to the other oppositely disposed surface of the first layer, a third plastics layer which is also better heat-sealable than the first layer, the sealability temperature of the second layer being lower than that of the third layer.

The term 'sealability temperature' is used here to denote that temperature at which the material is or becomes sealable. It may be in this case for example the metling temperature or the softening temperature. The important consideration in regard to the invention is that the material can be sealed at that temperature.

It has already been indicated hereinbefore that what is referred to as the second layer, with the lower sealability temperature than the third layer, must come to bear against the outward side of the double-folded, finished opening strip. The purpose of arranging the second layer on the opening strip on the outside thereof is that, when welding the individual packs together and separating the packs from each other, care must be taken to ensure that, although the opening strip of plastics material adheres in a liquid-tight manner to the doubled cardboard strip, the opening strip itself is open over the major part of the surface area thereof in a downward direction, towards the interior of the pack, and remains closed only by virtue of its upper connecting web portion. The purpose of that feature is that the pack can only then be opened because opening is effected only by tearing off the upper connecting web portion.

It has been found to be particularly advantageous if the first layer comprises polyester which is elongated in the longitudinal direction of the opening strip, the second layer comprises a thermoplastic ionomer resin on the basis of cross-linked ethylene copolymers and the third layer comprises PETG. The above-mentioned thermoplastic ionomer resin is marketed under the trade mark 'SURLYN'from Du Pont. It is for example a transparent plastics material which is resistant to oils and greases, for the packaging industry, and which has good welding capability.

For a better understanding of the present invention, and to show how the same may be carried out into effect, reference will now be made, by way of example, to the accompanying drawings, in which:

FIG. 1 is a perspective view of a liquid pack according to the invention having the opening seams, with upper outer triangular flaps being shown lifted up, FIG. 2 is a broken-away perspective view of the left-hand part of the pack of FIG. 1 in an open condition, seen slightly from above, with a gripping tongue portion and an upper connecting web portion being shown torn away.

Figure 7:
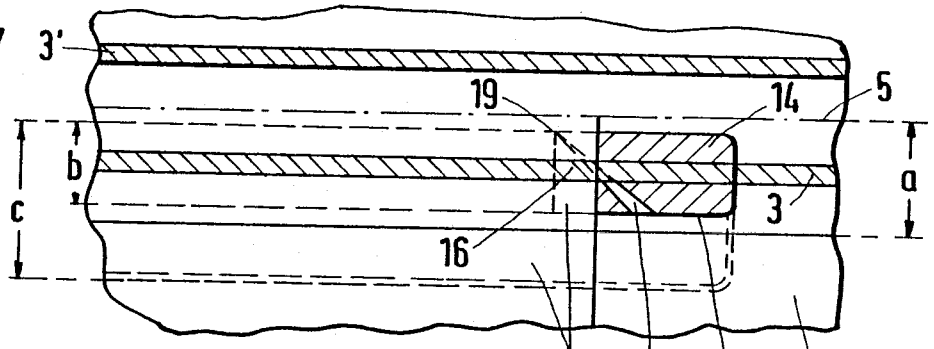
Figure 8:
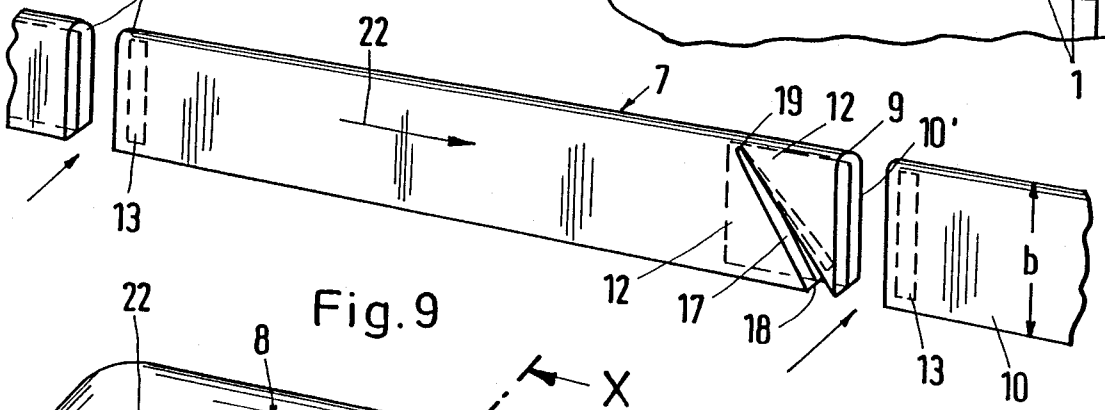
Figure 9:
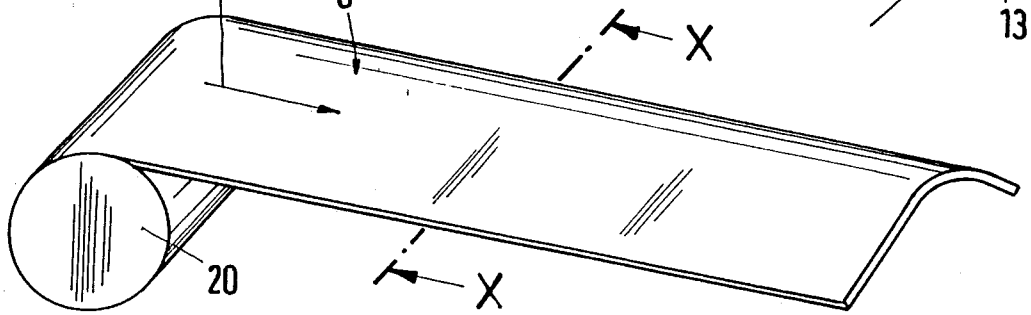
Figure 10:
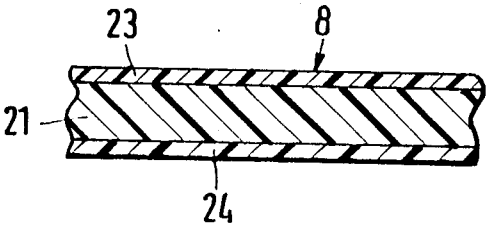
Figure 11:
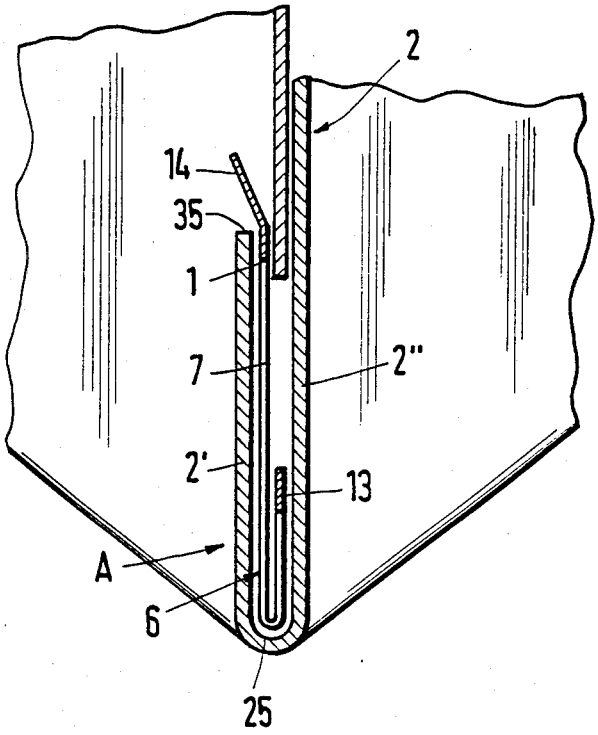

FIG. 3 is a broken-away diagrammatic perspective view in section taken along line III—III in FIG. 1, FIG. 4 is a diagrammatic perspective view of the opening strip which is in a U-shape and whose upper connecting web portion is half torn up, showing weakening lines, FIG. 5 is a broken-away view of the condition of the web of material when it is formed into a tube so that the longitudinal sealing seam can be produced, FIG. 6 is a broken-away view of a part of a web of material which is laid in a flat condition and in relation to which the opening strip, which has been folded in a U-shape, is placed and fixed, FIG. 7 shows the right-hand end of the opening strip, on a broken-away portion of the web of material on a larger scale than in FIG. 6, FIG. 8 is a broken-away perspective view of an isolated opening strip between broken-away portions of the double-ply plastics web, FIG. 9 shows the plastics web as it is drawn from the supply roll and already partially folded over into a U-shape, FIG. 10 is a view of the plastics web in section taken along line X—X in FIG. 9, and FIG. 11 is a plan view of the doubled cardboard strip with inserted opening strip in another embodiment of the invention in which the end sealing region is extended beyond the pouring-out tip and sealed in position only further towards the rear.

Referring to FIGS. 1 and 2, shown in diagrammatic form therein is the liquid pack in closed and opened condition respectively, with a plastics-coated cardboard carrier or backing material, the longitudinal weld seam 1 and the doubled cardboard strip 2 with the individual walls 2' and 2", in which the transverse weld seam 3 is disposed (see FIG. 7). FIG. 7 shows that broken-away part of the web of material 4 (the material is the cardboard which is coated with plastics material on both sides), in which the severing cut line 5 is shown, within the tube, between two successive packs. Therefore, the drawing also shows, approximately at the same distance from the line 5, a further transverse weld seam 3' which belongs to the bottom of the next pack.

In FIG. 1, reference numeral 6 generally denotes the opening means of which only a part still remains after the opening operation, as shown in FIG. 2, and comprises a double-ply opening strip 7 which is sealed on one side. The opening strip 7 is shown in broken lines in FIGS. 1 and 5, but is also shown at least in regard to part thereof in FIGS. 3, 4 and 6 to 8. The opening strip 7 is therefore described in particular detail.

It is made from a plastics web 8 (see FIGS. 9 and 10) and folded in a U-shape, as can be clearly seen from FIGS. 3, 4 and 8. The U-shape is open downwardly, that is to say, towards the interior of the pack. The upper connecting web portion 9 is the liquid-tight closure which joins the two limb portions 10, 10' together. In the embodiment shown in FIG. 4, it is separated from the limb portions 10 and 10' by weakening lines 11. In order to make the pack liquid-tight, the opening strip 7 is joined on its outward sides along the sealing seams 3*a* and 3*b* to the inward sides of the doubled cardboard strip 2. In addition, the opening strip 7 is welded to itself at the beginning end and the end (as considered in the tearing direction), that is to say it is welded over an area on its inward sides, thereby forming a beginning or initial sealing region 12 and an end or final sealing region 13.

Within the beginning sealing region 12 there is a first portion 14 forming a gripping tongue portion or flap which is shown clearly to be sticking out in a number of the Figures of drawings. The opening strip 7 is at the same time fixed in the longitudinal weld seam 1 by way of the second portion 15, more particularly at the location 16 (see FIG. 7) where the longitudinal weld seam 1 and the transverse weld seam 3 cross each other. Also shown within the beginning sealing region 12 is the tear-open slot 17 which extends from the outside at the front from the location 18 (see FIG. 8) upwardly and rearwardly to the end 19 in the vicinity of the upper connecting web portion 9. In that arrangement it passes completely through the opening strip 7, as can best be seen from FIG. 8.

FIG. 7 shows a first embodiment in which 'a' identifies the width of the doubled cardboard strip 2, the upper edge of which is defined by the dash-dotted cut line 5. The width or height 'b' of the opening strip 7 of which a first embodiment is shown in FIG. 7 by means of single broken lines is less than 'a'. FIG. 7 also shows by means of double broken lines a second embodiment in which the opening strip 7 is of the width 'c' which may be double the width 'b'. In that case the opening strip 7 is an opening strip which is provided to project from the doubled cardboard strip 2 into the interior of the pack.

Upon manufacture, the plastics web 8 of the opening strip 7 is drawn from a supply roll 20 as shown in FIG. 9 and folded into a U-shape, as is already indicated in the initial condition at the right-hand end of FIG. 9.

If a section is taken along line X—X in FIG. 9, then what is seen is the structure of the plastics web 8 as illustrated in FIG. 10. This structure comprises a first layer 21 of polyester which is elongated or stretched in the longitudinal direction 22, with a second plastics layer 23 of a thermoplastic ionomer resin on the basis of cross-linked ethylene copolymers being applied to the one surface of the first layer 21, while applied by lamination to the side of the first layer 21 which is in opposite relationship to the side which is shown at the top in FIG. 10, being therefore the lower side of the first layer 21, is a third layer 24 of PETG. The first layer 21 loses its weldability by virtue of the elongation or stretching effect. That is not the case with the second and third plastics layers 23 and 24, for which reason the second plastics layer 23 and the third plastics layer 24 can be sealed better than the first plastics layer. The two outer layers 23 and 24 also differ from each other in that the second plastics layer 23 which comes to lie on the outside on the opening strip 7 as shown in FIG. 8 has a lower sealability temperature than the third plastics layer 24.

FIGS. 2 and 11 show the pouring-out tip 25, FIG. 11 being in highly diagrammatic form in order clearly to show the individual layers, and not showing for example any sealing seams or portions which are pressed one on to the other. In that way it is possible to show the opening strip 7 with the gripping tongue portion 14 and the end sealing region 13, which otherwise would not be visible due to the closeness of the lines. The particularity of FIG. 11 is that the end sealing region 13 is not arranged at the front at the pouring-out tip 25 but only in the vicinity thereof, that is to say in the pouring-out region generally identified by A. In the embodiment shown in FIG. 11, the opening strip 7 is longer than for example in the case of the embodiment shown in FIG. 1. More particularly, as shown in FIG. 11, the strip 7, with the end sealing region 13, is extended upwardly towards the right beyond the pouring-out tip 25, and is only there fixed in position.

In general, a paper 4 which is prepared with an opening strip 7 is not to be wound on to a supply roll, because it would be too thick on one side. It is therefore preferred for the above-described process to begin in the region of a pack manufacturing machine or filling machine.

When packaging specific liquids such as for example H-milk or fruit juice, an aluminum foil can be welded on one side of the paper web between the paper and the plastics coating, for example the polyethylene. In that case also the sealing action may be provided in accordance with the invention, preferably in this case by means of high frequency welding. The heat is then generated in the aluminum foil and softens only the plastics material which is to be found in the vicinity of the irradiated location. In such a situation also care must be taken to ensure that the opening strip 7 is not sealed for example on the inward sides thereof, as was intentionally done previously in the beginning sealing region 12 and in the end sealing region 13, with a higher sealing temperature.

The opening strip is produced in such a way that firstly the three plastics layers are laminated together and that laminate structure is then generally stretched or elongated, and so forth.

I claim:

1. A pack for liquid comprising:

a plastics-coated cardboard carrier material; said cardboard carrier having a longitudinal weld seam and at least one transverse weld seam, said transverse weld seam being disposed in a doubled cardboard strip on a top section of the pack;

an opening means located in said top section, said opening means being in the form of an opening strip which is liquid-tight on one side and is oriented such that outward sides of the opening strip are joined to inward sides of the doubled cardboard strip, said opening strip being made of a laminated plastics material, one layer of which is oriented in one direction, said opening strip having limb portions with free ends to substantially form a U-shape in cross-section, said opening strip being oriented such that the free ends of the limb portions of the U-shape are directed inwardly into the pack, the limb portions being welded together at least at a beginning and an end section of the opening strip to form an initial sealing region and an end sealing region, respectively, the initial sealing region providing a gripping tongue portion projecting out of the doubled cardboard strip and being sealed in a region in the doubled cardboard strip where the longitudinal and transverse weld seams interact, and the end sealing region in the doubled cardboard strip is sealed in a pouring-out region of the opening means.

2. A pack according to claim 1, wherein a tear-open slot is provided within the initial sealing region, passing completely through the opening strip and extending rearwardly upwardly from lower free ends of the limb portions in the gripping tongue portion.

3. A pack according to claim 2, wherein an inner end of the tear-open slot is located adjacent to an upper connecting web portion of the two limb portions of the opening strip.

4. A pack according to claim 3, wherein the connecting web portion of the opening strip is located within an outside contour of the doubled cardboard strip.

5. A pack according to claim 1, wherein the opening strip projects from the doubled cardboard strip into the interior of the pack.

6. A pack according to claim 1, wherein the initial sealing region extends over the entire width of the opening strip.

7. A pack according to claim 2, having two weakening lines disposed between the limb portions in the region of a connecting web portion of the opening strip and extending along the opening strip.

8. A pack according to claim 7, wherein the two weakening lines start from an end of the tear-open slot.

9. A pack according to claim 1, wherein the end sealing region is welded in close proximity to a pouring-out tip of the opening means and wherein the opening strip extends from the gripping tongue portion beside the longitudinal weld seam to the pouring-out tip.

10. A pack according to claim 1, wherein the opening strip comprises a first plastics layer, which is oriented in a longitudinal direction, of the opening strip, a second plastics layer which is disposed on one surface of the first plastics layer which is better heat-sealable than the first layer, a third plastics layer disposed on the opposite surface of the first layer which is also better heat-sealable than the first layer, and wherein the heat sealability temperature of the second layer is lower than that of the third layer.

11. A pack according to claim 10, wherein the first layer is polyester which is elongated in the longitudinal direction of the opening strip, the second layer is a thermoplastic ionomer resin on the basis of cross-linked ethylene copolymers and the third layer is PETG.

12. A plastics web for an opening strip, having a first layer of the web oriented in one direction, a second platics layer which is better heat-sealable than the first layer applied to one surface of said first layer, and, applied to the other oppositely disposed surface of the first layer, a third plastics layer which is also better heat-sealable than the first layer, the sealability temperature of the second layer being lower than that of the third layer.

13. A plastics web according to claim 12, wherein the first layer is polyester which is elongated in a longitudinal direction of the opening strip, the second layer is a thermoplastic ionomer resin on the basis of cross-linked ethylene copolymers and the third layer is PETG.

* * * * *

UNITED STATES PATENT AND TRADEMARK OFFICE

CERTIFICATE OF CORRECTION

PATENT NO. : 4,787,507

DATED : November 29, 1988

INVENTOR(S) : Hans Rausing

It is certified that error appears in the above-identified patent and that said Letters Patent is hereby corrected as shown below:

Column 9, Claim 1, Line 42, change "interact" to --intersect--.

Signed and Sealed this

Fourth Day of April, 1989

*Attest:*

*Attesting Officer*

DONALD J. QUIGG

*Commissioner of Patents and Trademarks*